US007147444B2

(12) United States Patent
Cheon

(10) Patent No.: US 7,147,444 B2
(45) Date of Patent: Dec. 12, 2006

(54) ASSEMBLING MECHANISM OF DISCHARGE PIPE FOR HERMETIC COMPRESSOR AND METHOD THEREOF

(75) Inventor: Sung-Ho Cheon, Gyungsangnam-Do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/703,624

(22) Filed: Nov. 10, 2003

(65) Prior Publication Data

US 2004/0096338 A1 May 20, 2004

(30) Foreign Application Priority Data

Nov. 19, 2002 (KR) ..... 10-2002-0072091

(51) Int. Cl.
*F04B 39/12* (2006.01)

(52) U.S. Cl. ..... 417/410.5; 417/902

(58) Field of Classification Search ..... 417/410.5, 417/572, 902; 418/55.1
See application file for complete search history.

(56) References Cited

U.S. PATENT DOCUMENTS 3,209,991 A * 10/1965 Sauber ..... 417/902
4,815,947 A * 3/1989 Okoma et al. ..... 417/410.3
5,090,880 A * 2/1992 Mashimo ..... 418/55.1
5,183,400 A * 2/1993 Tada et al. ..... 417/902
5,261,800 A * 11/1993 Sakae ..... 417/902
6,158,995 A * 12/2000 Muramatsu et al. ..... 417/902
6,634,870 B1 * 10/2003 Dreiman et al. ..... 417/902
6,893,229 B1 * 5/2005 Choi et al. ..... 418/55.1
2004/0241012 A1 * 12/2004 Kim et al. ..... 417/902
2005/0002803 A1 * 1/2005 Kim ..... 417/902
2005/0008442 A1 * 1/2005 Matsumoto et al. ..... 417/902

FOREIGN PATENT DOCUMENTS

CN 1510280 A 7/2004

* cited by examiner

*Primary Examiner*—Michael Koczo, Jr.
(74) *Attorney, Agent, or Firm*—Birch, Stewart, Kolasch & Birch, LLP

(57) ABSTRACT

An assembling mechanism of a discharge pipe and a method thereof, capable of preventing deformation of an upper cover and a compression unit generated in assembling the discharge pipe by improving assembling mechanism of the discharge pipe, thus to improve performance of the compressor. The assembling mechanism includes an upper cover on which a guide member having a discharge pipe inserted therein is mounted, a muffler in which an insertion hole having the discharge pipe inserted therein is formed, a first connection portion for welding/combining the discharge pipe and the muffler after inserting the discharge pipe in the insertion hole and a second connection portion for welding/combining the upper cover and discharge pipe.

14 Claims, 7 Drawing Sheets

ASSEMBLING MECHANISM OF DISCHARGE PIPE FOR HERMETIC COMPRESSOR AND METHOD THEREOF

This Nonprovisional application claims priority under 35 U.S.C. §119(a) on Patent Application No(s). 2002-72091 filed in KOREA on Nov. 19, 2002, the entire contents of which are hereby incorporated by reference.

BACKGROUND OF THE INVENTION

1. Field of the Invention

The present invention relates to an assembling mechanism of a discharge pipe and a method thereof and particularly, to an assembling mechanism of a discharge pipe for a hermetic compressor and a method thereof, capable of preventing deformation of parts generated in an assembling operation of a discharge pipe and improving efficiency of a compressor.

2. Description of the Background Art

Generally, a compressor can be formed by various types according to compressing methods, and as an air conditioning apparatus which is required to be smaller and lighter, a hermetic rotary compressor is mainly used.

The hermetic compressor can be divided into a rotary compressor, reciprocating compressor, scroll compressor and the like according to the method of compressing fluid.

FIG. 1 is a cross-sectional view showing a scroll compressor in accordance with the conventional art.

The scroll compressor of the conventional art includes a casing in which a suction pipe 102 to which fluid is sucked and a discharge pipe 104 through which compressed fluid is discharged are respectively connected, having a hermetic space therein, a driving unit 108 which is positioned at the lower side of the casing 106, for generating a driving force and a compression unit which is positioned at the upper side of the casing 106 and is connected with the driving unit 108 by the rotational shaft 112, for compressing fluid sucked to the suction pipe 102 by rotation of the rotational shaft 112 and discharging the fluid to the discharge pipe 104.

In the casing 106, an upper cover 114 is mounted so that it can be sealed, a main frame 116 for rotably supporting the upper side of the rotational shaft 112 and supporting the compression unit 110 is installed and a discharge pipe 104 is penetrated so that it can be sealed.

The driving unit 108 includes a stator 120 which is fixed in the circumferential direction of the casing 106 and a rotor 122 which is positioned on the inner circumferential surface of the stator 120 and is fixed on the rotational shaft 112. When a power is applied to the stator 120, the rotor 122 rotates by interaction of the stator 120 and the rotor 122, thus to rotate the rotational shaft 112.

The compression unit 110 includes a fixed scroll 128 in which a fixed wrap of an involute shape is formed and which is fixed at the upper side of the casing 106, and an orbiting scroll 132 in which an orbiting wrap 130 of an involute shape which corresponds to the fixed wrap 126 is formed to have a predetermined compression space between the orbiting wrap and the fixed wrap 126, and which is supported in the main frame so that it can perform an orbiting movement when the rotational shaft 112 rotates.

A discharge passage 136 through which compressed fluid can be discharged is formed at the center of the fixed scroll 128, a check valve 138 for preventing inverse flow of the discharged fluid is installed at the upper side of the discharge passage 136, and a muffler 140 for reducing noise of the fluid discharged through the discharge passage 136 is installed on the upper surface of the fixed scroll 128.

Here, muffler 140 is connected with the discharge pipe 104 and the discharge pipe 104 is penetrated at a side of the upper cover 114 so that it can be sealed.

FIGS. 2 and 3 are cross-sectional views showing assembling processes of the muffler, discharge pipe and upper cover in accordance with the conventional art.

As shown in FIG. 2, an indenting hole 142 in which the discharge pipe 104 is indented is formed at a side of the muffler 140 to be tapered at a predetermined angle, and a guide member 144 is welded/combined to a side of the upper cover 114. The upper cover 114 is fixed on the upper surface of the casing 106 by welding so that it can be sealed.

As shown in FIG. 3, the discharge pipe 104 passes the guide member 144 and accordingly is fixed on the indenting hole 142 formed in the muffler 140 by indenting.

When the indenting operation of the discharge pipe 104 is completed, the guide member 144 and the discharge pipe 104 are welded and combined.

However, with the above assembling method of the discharge pipe of the scroll compressor in accordance with the conventional art, deformation is generated in the upper cover and the compression unit by indenting pressure in indenting the discharge pipe in the indenting hole of the muffler and leakage of fluid is generated in case indenting between the muffler and the discharge pipe is not complete, thus to degrade performance and efficiency of the compressor.

Also, since additional indenting devices are required to indent the discharge pipe, the manufacturing cost increases.

SUMMARY OF THE INVENTION

Therefore, an object of the present invention is to an assembling mechanism of a discharge pipe for a hermetic compressor and a method thereof, capable of improving performance of the compressor by preventing deformation of an upper cover and a compression unit generated in assembling the discharge pipe by improving the assembling mechanism of the discharge pipe.

Another object of the present invention is to provide an assembling mechanism of a discharge pipe for a hermetic compressor and a method thereof, capable of improving efficiency of the compressor by preventing leakage between the discharge pipe and the muffler.

Still another object of the present invention is to provide an assembling mechanism of a discharge pipe for a hermetic compressor and a method thereof, capable of reducing manufacturing cost since additional devices, such as a press-insertion device and the like are not needed in assembling operation of the discharge pipe.

To achieve these and other advantages and in accordance with the purpose of the present invention, as embodied and broadly described herein, there is provided assembling mechanism of a discharge pipe for a hermetic compressor, including an upper cover which is fixed to the upper side of the casing and on which a guide member having a discharge pipe inserted therein is mounted, a muffler which is fixed on the upper surface of the compression unit which compresses fluid, and in which an insertion hole having the discharge pipe inserted therein is formed, a first connection portion for welding/combining the discharge pipe and the muffler after inserting the discharge pipe in the insertion hole and a second connection portion for welding/combining the upper cover and discharge pipe after passing the discharge pipe through the guide member.

An inlet of the insertion hole and an outer circumferential surface of the discharge pipe are welded/combined in a circumferential direction after inserting the discharge pipe in the insertion hole of the muffler in the first connection portion of the assembling mechanism of the discharge pipe.

A portion between the discharge pipe and the muffler is welded/combined by a brazing method.

An inlet of the insertion hole and an outer circumferential surface of the discharge pipe are combined in a circumferential direction by projection welding after inserting the discharge pipe in the insertion hole of the muffler in the first connection portion of the assembling mechanism of the discharge pipe.

An insertion member is inserted in a gap between the discharge pipe and the guide member, a portion between the discharge pipe and the insertion member and a portion between the insertion member and guide member are connected by welding in the second connection portion of the assembling mechanism of the discharge pipe.

The guide member is formed in a cylindrical shape having a larger diameter than that of the discharge pipe.

The insertion member is formed in a cylindrical shape having a predetermined thickness so that the insertion member can be inserted in a gap between the discharge pipe and the guide member.

In the second connection portion of the assembling mechanism of the discharge pipe, an insertion member is inserted in a gap between the discharge pipe and the guide member, and the insertion member includes a first cylindrical portion which is inserted in the inner circumferential surface of the guide member and is welded/combined with the guide member, and a second cylindrical portion which is extended from the first cylindrical portion, has a diameter smaller than that of the first cylindrical portion, and is welded/combined with the discharge pipe being abutted on the outer circumferential surface of the discharge pipe.

In the second connection portion of the assembling mechanism of the discharge pipe, a portion between a connection pipe and the guide member and a portion between the connection pipe and discharge pipe are simultaneously welded/combined after inserting the connection pipe between the discharge pipe and the guide member.

The connection pipe is welded/combined with a muffler, the discharge pipe is inserted in the connection pipe and welded and combined with the connection pipe.

To achieve these and other advantages and in accordance with the purpose of the present invention, as embodied and broadly described herein, there is provided assembling mechanism of a discharge pipe for a hermetic compressor, including an upper cover which is fixed with the upper side of the casing and is connected with a guide member in which a discharge pipe is inserted, a muffler which is fixed on the upper surface of the compression unit for compressing fluid, and in which an insertion hole having the discharge pipe inserted therein is formed, a first connection portion in which a sealing member is attached on the inner circumferential surface of the insertion hole and a tap is formed on the outer circumferential surface of the discharge pipe, for connecting the discharge pipe and the muffler by adhering the tap on the inner circumferential surface of the sealing member and a second connection portion for welding/combining the guide member and the discharge pipe.

The sealing member is formed with materials having an elastic force with a predetermined strength to adhere the tap on the outer circumferential surface of the discharge pipe.

To achieve these and other advantages and in accordance with the purpose of the present invention, as embodied and broadly described herein, there is provided an assembling method of a discharge pipe for a hermetic compressor, including a first step of inserting a discharge pipe in an insertion hole of a muffler which is fixed on the upper surface of a compression unit, a second step of welding/combining the outer circumferential surface of the discharge pipe and the inlet of the insertion hole, a third step of inserting the discharge pipe in the guide member mounted on an upper cover and fixing the upper cover on the upper surface of the casing so that it can be sealed, a fourth step of inserting the insertion member between the guide member and the discharge pipe and a fifth step of welding and combining a portion between the guide member and the insertion member and a portion between the insertion member and the discharge pipe.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

There can be a plurality of embodiments of the assembling mechanism and method of a discharge pipe for a hermetic compressor in accordance with the present invention. Hereinafter, the most preferred embodiment will be described.

Figure 1:
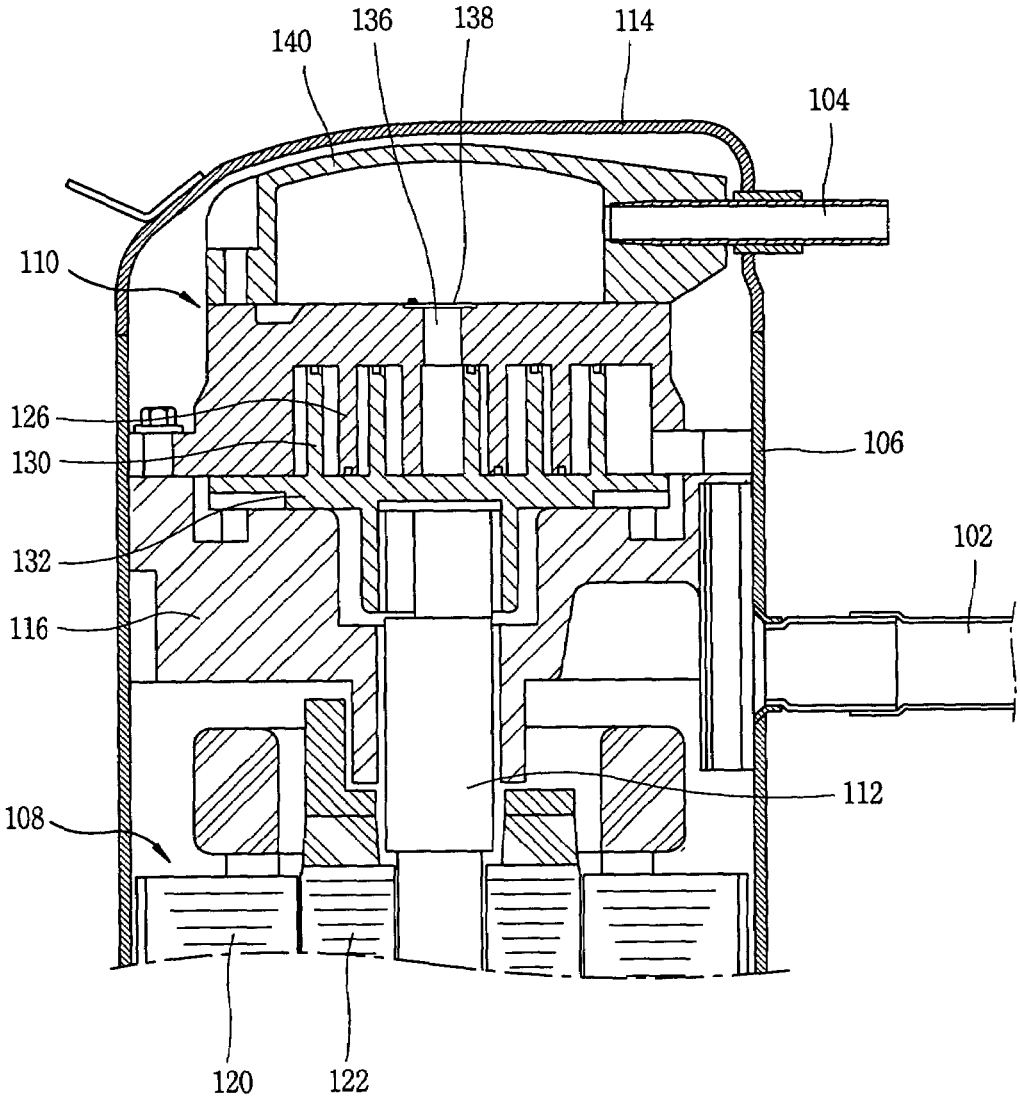
FIG. 1 CONVENTIONAL ART
FIG. 1 is a cross-sectional view showing a hermetic compressor in accordance with the conventional art.
Figure 2:
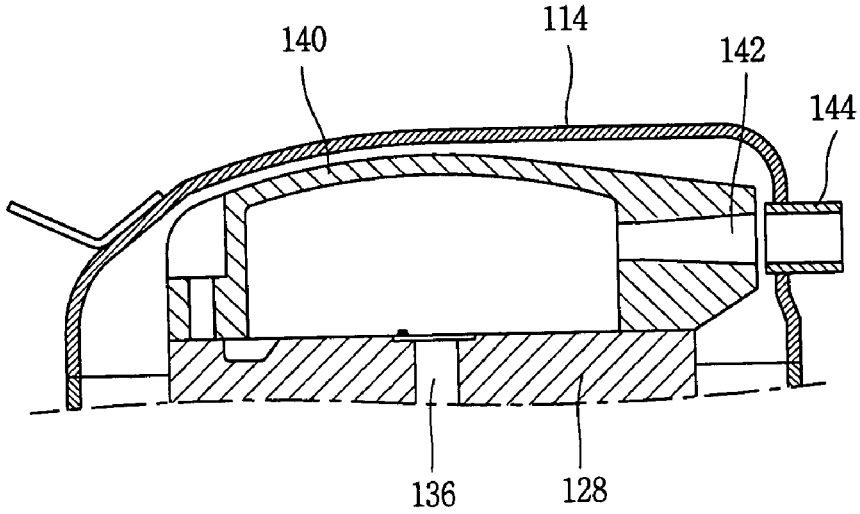
FIG. 2 CONVENTIONAL ART
FIGS. 2 and 3 are cross-sectional views showing assembling processes of a discharge pipe of the hermetic compressor in accordance with the conventional art.
Figure 3:
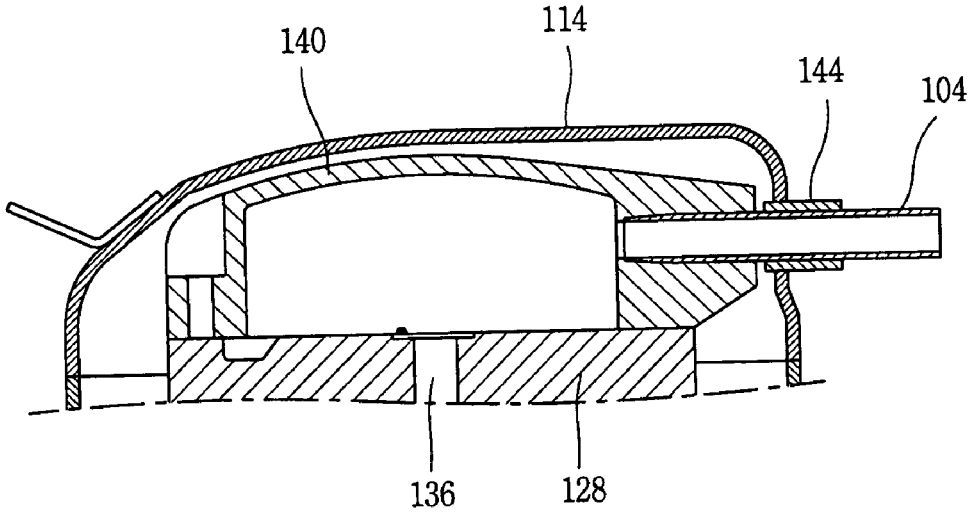
FIG. 3 CONVENTIONAL ART
Figure 4:
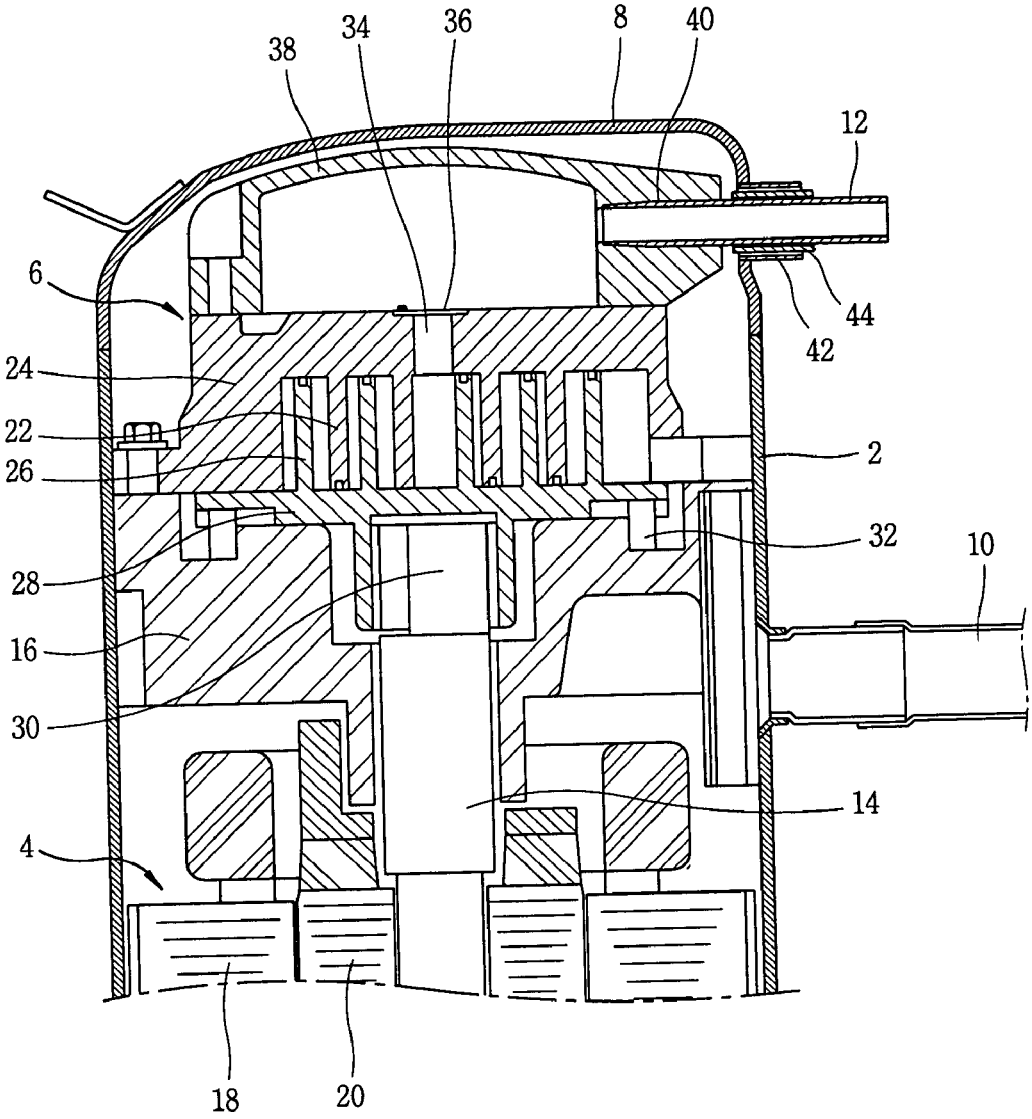
FIG. 4 is a cross-sectional view showing a hermetic compressor in accordance with the present invention.

FIG. 4 is a cross-sectional view showing a hermetic compressor in accordance with the present invention.

The hermetic compressor in accordance with the present invention includes a casing 2 having a hermetic space, a driving unit 4 which is mounted in the casing 2, for generating a driving force, and a compression unit 6 which is connected to the driving unit 4 and the rotational shaft 14, for discharging fluid to the outside thereof by compressing the fluid by a driving force of the driving unit 4.

An upper cover 8 is mounted at the upper side of the opened portion of the casing 2 so that it can be sealed, a suction pipe 10 to which fluid is sucked is connected at a side of the casing 2, and a discharge pipe 12 through which compressed fluid is discharged is connected to a side of the upper cover 8. A main frame 16 for rotably supporting the rotational shaft 14 and supporting the compression unit 6 is mounted inside the casing 2.

The driving unit 4 includes a stator 18 which is fixed on the inner circumferential surface of the casing 2 and a rotor 20 which is positioned on the inner circumferential surface of the stator 18 and is fixed on the rotational shaft 14. When a power is applied to the stator 18, the rotor 20 rotates by interaction of the stator 18 and the rotor 20, thus to rotate the rotational shaft 14.

The compression unit 6 includes a fixed scroll 24 in which a fixed wrap 22 of an involute shape is formed and which is fixed at the upper side of the casing 2, an orbiting scroll 28 in which an orbiting wrap 26 of an involute shape which corresponds to the fixed wrap 22 is formed to have a predetermined compression space between the orbiting wrap and the fixed wrap 22, and which is supported in the main frame 16 so that it can perform an orbiting movement being connected with an eccentric portion 30 of the rotational shaft 14.

Here, a discharge hole 34 through which compressed fluid can be discharged is formed at the center of the fixed scroll 24, a check valve 36 for preventing inverse flow of the discharged fluid is installed on the upper side surface of the fixed scroll 24, and a muffler 38 for reducing noise of the fluid discharged through the discharge hole 34 is mounted on the upper surface of the fixed scroll 24.

FIGS. 5 to 8 are cross-sectional views showing assembling processes of a discharge pipe of a hermetic compressor in accordance with a first embodiment of the present invention.

The assembling mechanism of the discharge pipe includes a first connection portion for welding/combining between the muffler 38 and the discharge pipe 12 and a second connection portion for welding/combining the upper cover 8 and the discharge pipe 12.

Here, in the first connection portion, an insertion hole 40 having the discharge pipe 12 inserted at a side of the muffler 38 is formed at a side of the muffler 38, and the discharge pipe 12 and the muffler 38 are welded/combined after inserting the discharge pipe 12 in the insertion hole 40.

In the second connection portion, a guide member 42 having an inner diameter larger than the outer diameter of the discharge pipe 12 is mounted at a side of the upper cover 8 so that the discharge pipe 12 can pass, an insertion member 44 is inserted in a gap between the discharge pipe 12 and the guide member 42, and a portion between the discharge pipe 12 and the insertion member 44 and a portion between the insertion member 44 and the guide member 42 are combined by welding.

The assembling processes of the mechanism of the discharge pipe with the above structure will be described as follows.

Figure 5:
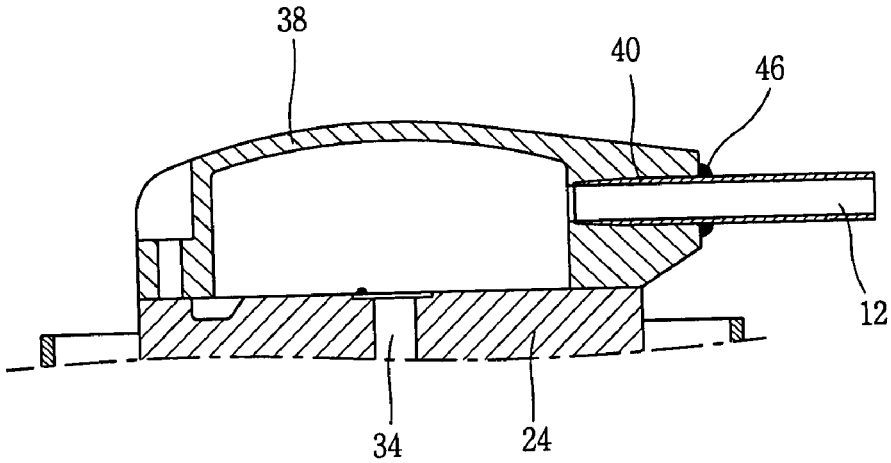
FIGS. 5 to 8 are cross-sectional views showing an assembling process of a discharge pipe of a hermetic compressor in accordance with a first embodiment of the present invention.

Firstly, as shown in FIG. 5, the inlet of the insertion hole 40 and an outer circumferential surface of the discharge pipe 12 are welded/combined in a circumferential direction after inserting the discharge pipe 12 in the insertion hole 40 of the muffler 38. Then, a welding bead 46 is formed between the discharge pipe 12 and the insertion hole 40 in the circumferential direction, thus to prevent the fluid compressed inside the muffler 38 from leaking into the casing 2.

Here, it is desirable that welding/combining between the discharge pipe 12 and the insertion hole 40 is performed by a brazing method.

Figure 6:
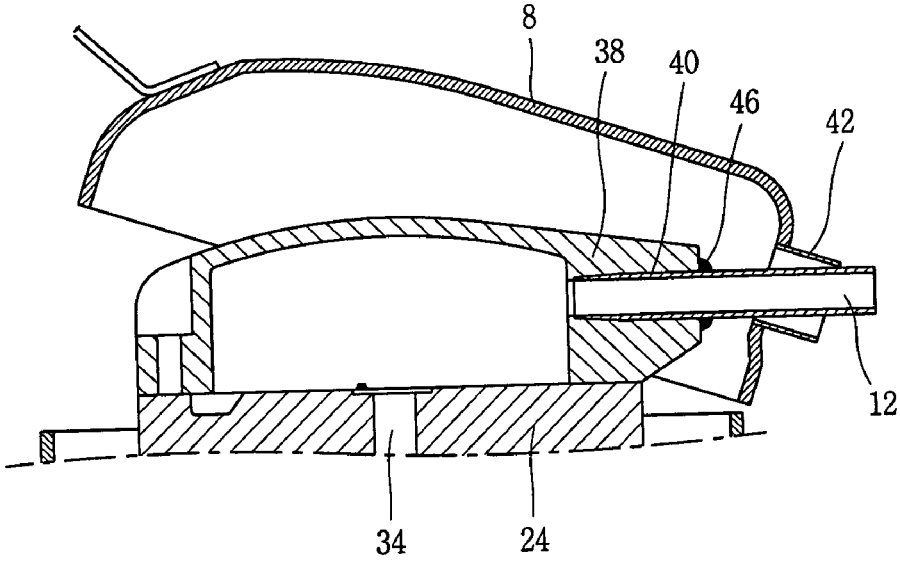

Then, as shown in FIG. 6, the upper cover 8 is fixed to the upper side of the muffler 38. That is, by having the upper cover 8 to be slanted at a predetermined angle, the discharge pipe 12 which is welded/combined with the muffler is inserted in the guide member 42 and then is fixed on the upper surface of the opened portion of the casing 2 so that it can be sealed.

Here, since the inner diameter of the guide member 42 is relatively larger than the outer diameter of the discharge pipe 12, the discharge pipe 12 can be inserted in the guide member 42 under the condition that the upper cover 8 is slanted at a predetermined angle.

It is desirable that the upper cover 8 is welded/combined on the upper surface of the opened portion of the casing 2 in the circumferential direction.

Figure 7:
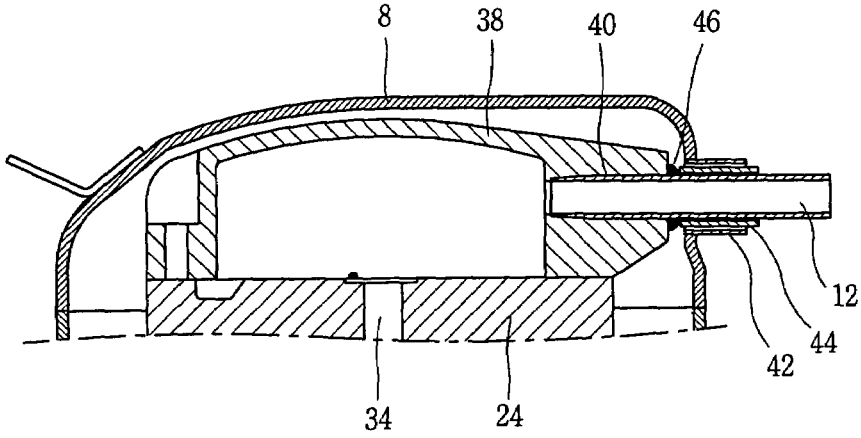

After completing the above process, as shown in FIG. 7, the insertion member 44 is inserted in a gap between the inner diameter of the guide member 42 and outer diameter of the discharge pipe 12.

Figure 8:
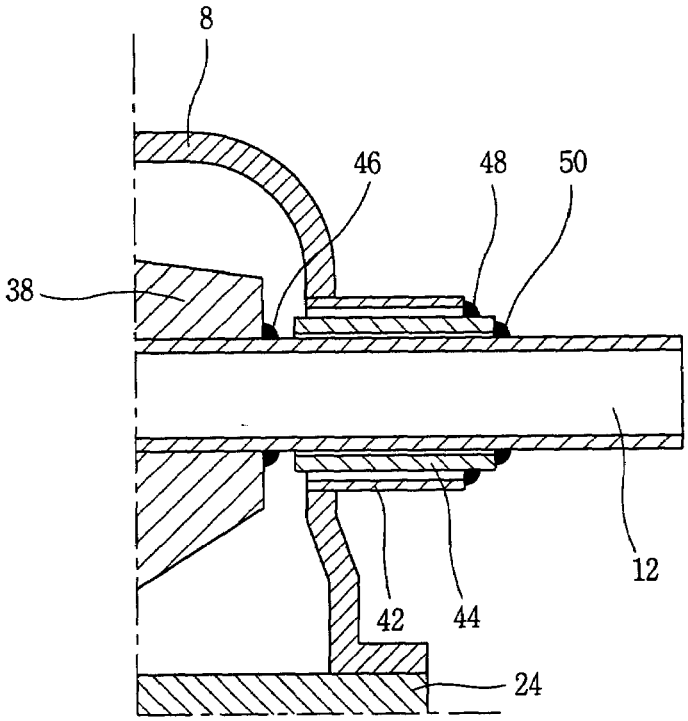

As shown in FIG. 8, a portion between the end of the guide member 42 and the outer circumferential surface of the insertion member 44 is welded/combined in the circumferential direction, and a portion between the end of the insertion member 44 and the outer circumferential surface of the discharge pipe 12 is welded/combined in the circumferential direction.

Here, a welding bead 48 with a predetermined thickness is formed in a circumferential direction between the guide member 42 and the insertion member 44, and a welding bead 50 with a predetermined thickness is formed in a circumferential direction between the insertion member 44 and the discharge pipe 12, thus to prevent leakage of fluid inside the compressor.

Figure 9:
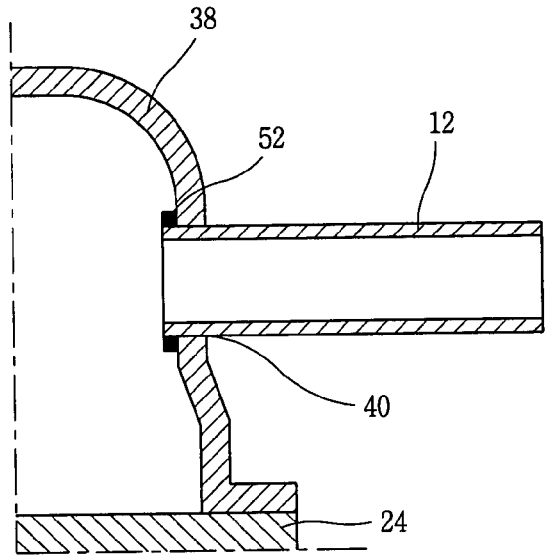
FIG. 9 is a cross-sectional view showing an assembly structure of the discharge pipe of the hermetic compressor in accordance with a second embodiment of the present invention.

FIG. 9 is a cross-sectional view showing an assembling mechanism of the discharge pipe of the hermetic compressor in accordance with a second embodiment of the present invention.

The assembling mechanism of the discharge pipe in accordance with a second embodiment includes a first connection portion for connecting between the muffler 38 and the discharge pipe 12 by projecting welding after inserting the discharge pipe 12 in the insertion hole 40 of the muffler 38. In accordance with the second embodiment, the assembling mechanism includes a second connecting portion for welding/combining between the discharge pipe 12 and the upper cover 8 as shown in FIGS. 7 and 8.

Here, the muffler 38 is formed with a relatively small thickness, the muffler 38 and the discharge pipe 12 are combined by projection welding, and accordingly, a welding bead 52 is formed between the inner surface of the muffler 38 and the outer circumferential surface of the discharge pipe 12 inserted in the insertion hole 40 in the circumferential direction.

The welded/combined structure of the second connection portion has an identical structure as that of the above described embodiment.

Figure 10:
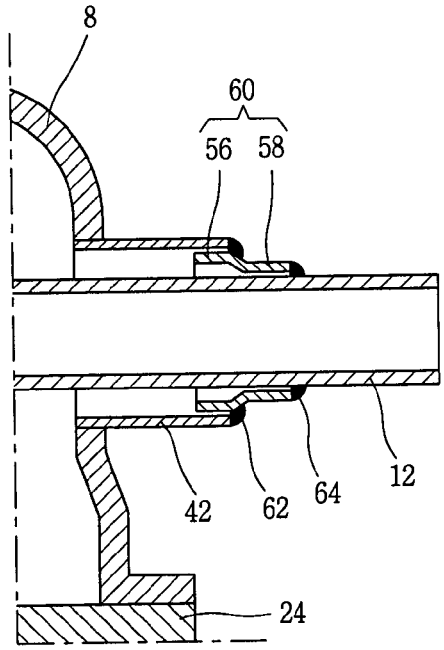
FIG. 10 is a cross-sectional view showing an assembly structure of the discharge pipe of the hermetic compressor in accordance with a third embodiment of the present invention.

FIG. 10 is a cross-sectional view showing an assembling mechanism of the discharge pipe of the hermetic compressor in accordance with a third embodiment of the present invention.

The assembling mechanism of the discharge pipe in accordance with the third embodiment includes a first connection portion for welding/combining the discharge pipe with the muffler as shown in FIG. 9. In accordance with the third embodiment, the assembling mechanism includes a second connection portion in which the discharge pipe 12 is inserted inside the guide member 42 mounted in the upper cover 8 and the insertion member 60 is inserted in a gap between the guide member 42 and the discharge pipe 12 to be welded and combined together.

The first connection portion has an identical structure as the assembly structure described in the above embodiment.

The insertion member 60 of the second connection portion includes a first cylindrical portion 56 which is contacted on the inner circumferential surface of the guide member 42 and a second cylindrical portion 58 which is extended from the first cylindrical portion 56, has a diameter smaller than that of the first cylindrical portion, and is contacted on outer circumferential surface of the discharge pipe 12.

The end of the guide member 42 and the outer circumferential surface of the first cylindrical portion 56 are welded/combined and accordingly a welding bead 62 is formed in the circumferential direction. The outer circumferential surface of the discharge pipe 12 and the end of the second cylindrical portion 58 are welded/combined and accordingly, a welding bead 64 is formed in the circumferential direction.

Figure 11:
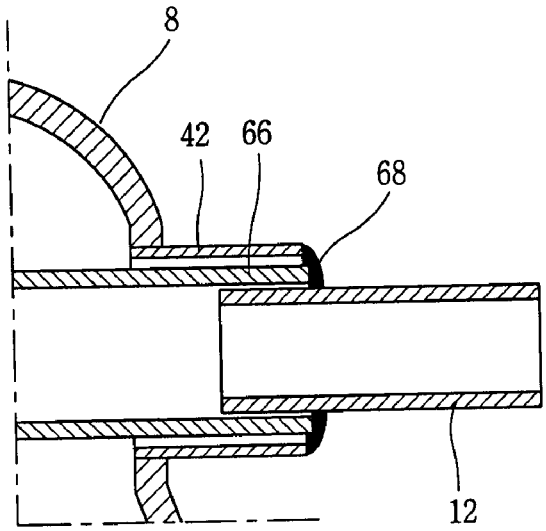
FIG. 11 is a cross-sectional view showing an assembly structure of the discharge pipe of the hermetic compressor in accordance with a fourth embodiment of the present invention.

FIG. 11 is a cross-sectional view showing an assembling mechanism of the discharge pipe in accordance with a fourth embodiment of the present invention.

In the assembling mechanism of the discharge pipe in accordance with a fourth embodiment, the discharge pipe is inserted in the guide member 42 fixed with the upper cover 8, a connection pipe 66 is inserted between the discharge pipe 12 and the upper cover 8, and a portion between a connection pipe and the guide member 42 and a portion between the connection pipe 66 and discharge pipe 12 are simultaneously welded/combined.

Here, the connection pipe 66 is connected with the muffler 38, and the discharge pipe 12 is connected with the connection pipe 66 by forming a length thereof shortly. That is, the connection pipe 66 is connected with the muffler 38 so that it can be sealed by methods such as welding and the like as shown for discharge pipe 12 in FIGS. 7 and 9, the discharge pipe 12 is formed to have a short length to minimize the gap from the connection pipe 66, and the guide member 42, connection pipe 66 and the discharge pipe 12 are simultaneously welded/combined, thus to form a welding bead 68.

Figure 12:
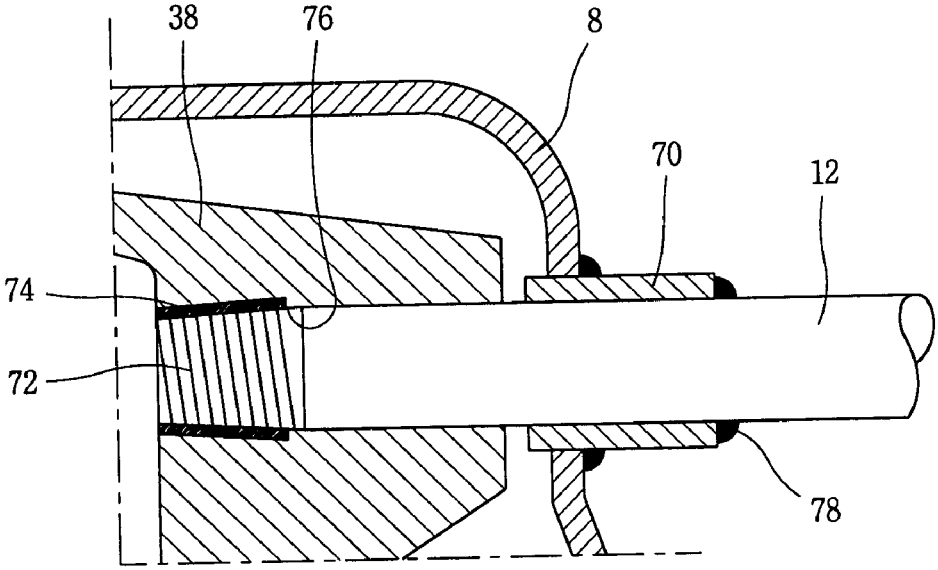
FIG. 12 is a cross-sectional view showing an assembly structure of the discharge pipe of the hermetic compressor in accordance with a fifth embodiment of the present invention.

FIG. 12 is a cross-sectional view showing an assembling mechanism of the discharge pipe in accordance with a fifth embodiment of the present invention.

The assembling mechanism of the discharge pipe in accordance with the fifth embodiment includes a first connection portion in which a sealing member 74 is attached on the inner circumferential surface of the insertion hole 76 of the muffler 38, a tap 72 is formed on the outer circumferential surface of the front side of the discharge pipe 12, and the tap 72 is adhered to the sealing member 74 to be mounted so that it can be sealed, and a second connection portion for welding/combining the guide member 70 and the discharge pipe 12 after passing the discharge pipe 12 through he guide member 70 fixed on the upper cover 8.

Here, it is desirable that the sealing member 74 is formed with materials having an elastic force of a predetermined strength so that the tap formed on the outer circumferential surface of the discharge pipe 12 can be adhered.

In the second connection portion, a welding bead 78 is formed in the circumferential direction by welding/combining the end of the guide member 70 and the outer circumferential surface of the discharge pipe 12 after inserting the discharge pipe 12 in the guide member 70.

In the assembling processing of the assembling mechanism of the discharge pipe in accordance with the fifth embodiment, firstly, when the discharge pipe 12 is inserted in the guide member 70 under the condition that the upper cover 8 is fixed on the upper surface of the casing 2 and the tap formed at the front of the discharge pipe 12 is indented in the sealing member 74 attached on the inner circumferential surface of the insertion hole 76 of the muffler 38, the tap 72 is adhered to the sealing member 72. Then, the discharge pipe 12 and the guide member 70 are welded, and assembling is completed.

As described above, the assembling mechanism of the discharge pipe of the hermetic compressor in accordance with the present invention can prevent leakage of fluid by welding/combining the discharge pipe and the insertion hole of the muffler, and can prevent deformation of the compression unit and upper member by indenting operation of the discharge pipe, thus to improve performance of the compressor.

Also, since additional indenting devices for indenting operation of the discharge pipe are not required, assembling operation is simple and manufacturing cost can be reduced.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A connection assembly of a discharge pipe for a hermetic compressor, comprising:

an upper cover having a guide member;

a discharge pipe inserted therein in the guide member;

a muffler having an insertion hole, the discharge pipe being inserted is through the insertion hole; and an insertion member being inserted in a gap between the discharge pipe and the guide member.

2. The assembly of claim 1, wherein an inlet of the insertion hole and an outer circumferential surface of the discharge pipe are welded and combined in a circumferential direction after inserting the discharge pipe in the insertion hole of the muffler.

3. The assembly of claim 2, wherein a portion of the discharge pipe and the muffler is connected by a brazing method.

4. The assembly of claim 1, wherein an inlet of the insertion hole and an outer circumferential surface of the discharge pipe are combined in a circumferential direction by projection welding after inserting the discharge pipe in the insertion hole of the.

5. The assembly of claim 2, wherein a portion of the discharge pipe and the insertion member and a portion of the insertion member and guide member are connected by welding.

6. The assembly of claim 5, wherein the guide member is formed in a cylindrical shape having a larger diameter than that of the discharge pipe.

7. The assembly of claim 5, wherein the insertion member is formed in a cylindrical shape having a predetermined thickness so that the insertion member can be inserted in the gap between the discharge pipe and the guide member.

8. The assembly of claim 1, wherein the insertion member includes a first cylindrical portion which is inserted in the inner circumferential surface of the guide member and is connected with the guide member, and a second cylindrical portion which is extended from the first cylindrical portion, has a diameter smaller than that of the first cylindrical portion, and is connected with the discharge pipe being abutted on the outer circumferential surface of the discharge pipe.

9. The assembly of claim 1, wherein the insertion member is a connection pipe, a portion of connection pipe and the guide member and a portion of the connection pipe and discharge pipe are simultaneously connected after inserting the connection pipe between the discharge pipe and the guide member.

10. The mechanism of claim 9, wherein the connection pipe is connected with the muffler, the discharge pipe is inserted in the connection pipe and connected with the connection pipe.

11. An assembling method of a discharge pipe for a hermetic compressor, comprising:

a first step of inserting a discharge pipe in an insertion hole of a muffler which is fixed on an upper surface of a compression unit;

a second step of connecting the outer circumferential surface of the discharge pipe and the inlet of the insertion hole;

a third step of inserting the discharge pipe in a guide member mounted on an upper cover and fixing an upper cover on a upper surface of the casing so that it can be sealed;

a fourth step of inserting an insertion member between the guide member and the discharge pipe; and a fifth step of connecting a portion between the guide member and the insertion member and a portion between the insertion member and the discharge pipe.

12. The method of claim 11, wherein the outer circumferential surface of the discharge pipe and the insertion hole of the muffler are connected by a brazing method in the second step.

13. The method of claim 12, wherein the outer circumferential surface of the discharge pipe and the insertion hole of the muffler are connected by projection welding in the second step.

14. The method of claim 12, wherein the discharge pipe is inserted in the guide member after slanting the upper cover at a predetermined angle, and the upper cover is connected on the upper surface of the casing in the third step.

* * * * *